United States Patent [19]

DeWitt

[11] 3,977,744

[45] Aug. 31, 1976

[54] POSSE BOX REPORT CLIP BOARD

[76] Inventor: F. Carlos DeWitt, 14932 Trojan Circle, Huntington Beach, Calif. 92647

[22] Filed: Feb. 3, 1975

[21] Appl. No.: 546,706

[52] U.S. Cl. ..... 312/231; 206/214; 220/20

[51] Int. Cl.[2] ..... B65D 57/00; A45C 11/34

[58] Field of Search ..... 312/231, 291, 235 A; 24/67.7; 281/45; 108/35, 43; 248/452; 220/20; 206/214

[56] References Cited

UNITED STATES PATENTS

| | | | |
|---|---|---|---|
| 275,882 | 4/1883 | Brownell | 312/231 |
| 297,284 | 4/1884 | Mudgett | 248/452 |
| 302,774 | 7/1884 | Polkinhorn | 312/231 |
| 767,293 | 8/1904 | Kraus | 206/214 |
| 1,354,211 | 9/1920 | Reed | 220/20 |
| 1,503,949 | 8/1924 | Helm | 206/214 |
| 1,529,982 | 3/1925 | Bunzli | 312/231 |
| 1,827,929 | 10/1931 | Bigelow | 220/20 |
| 2,417,879 | 3/1947 | Merritt | 206/214 |
| 2,850,296 | 9/1958 | Ratliff | 220/20 |
| 3,776,411 | 12/1973 | Luckadoo | 220/20 |

FOREIGN PATENTS OR APPLICATIONS

| | | | |
|---|---|---|---|
| 1,074,125 | 10/1954 | France | 312/231 |

*Primary Examiner*—Paul R. Gilliam
*Assistant Examiner*—Victor N. Sakran
*Attorney, Agent, or Firm*—Knobbe, Martens, Olson, Hubbard & Bear

[57] ABSTRACT

A combination two-compartment clip board for containing report forms and reports and providing a writing surface for preparing reports is disclosed.

9 Claims, 9 Drawing Figures

FIG. 4.
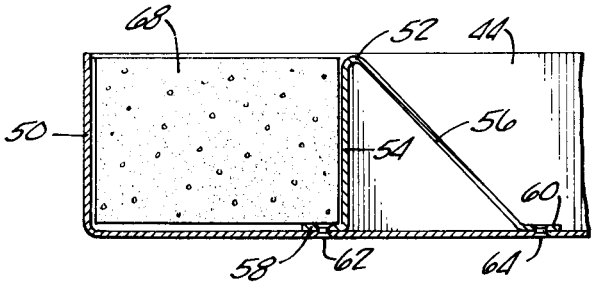
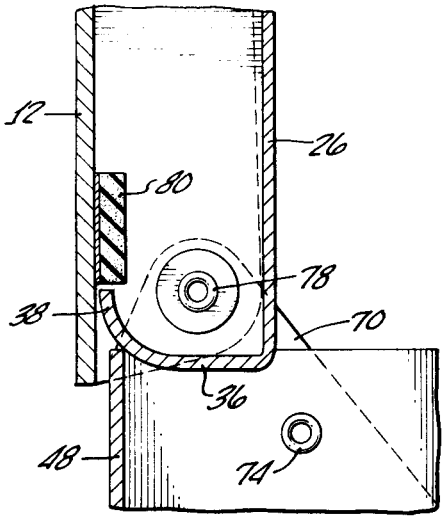
FIG. 6.
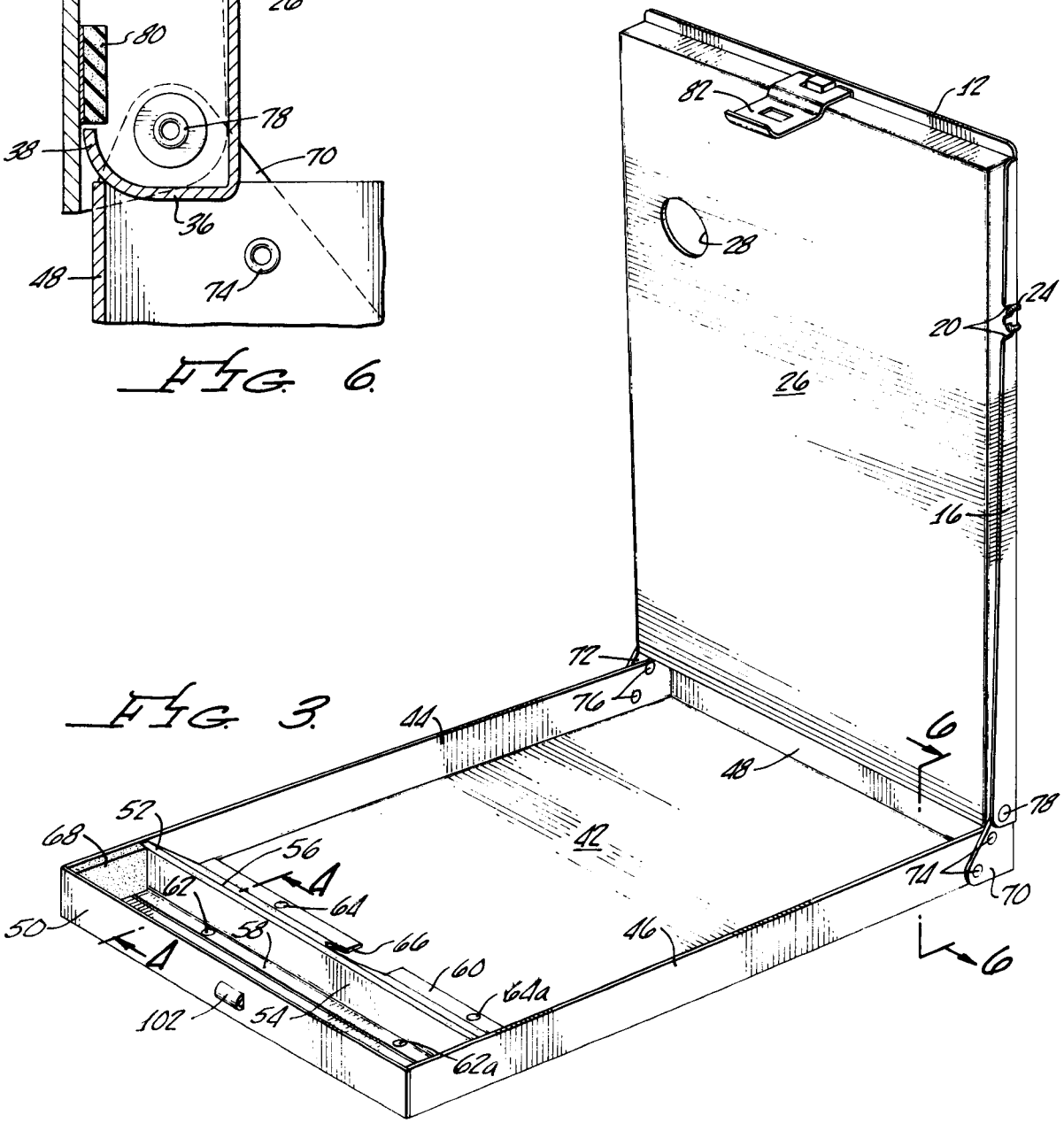
FIG. 3.

POSSE BOX REPORT CLIP BOARD

This invention relates to writing and storage equipment. Specifically, this invention relates to a combination storage box for report forms and completed reports and a clip board providing a writing surface.

It is the general practice in many professions and trades to utilize a clip board to hold individual sheets or pads of plain or printed paper for preparing notes, reports, etc. It is necessary in many trades and professions to carry one or more types of specialized reports and it is often necessary to carry various reference pamphlets.

In law enforcement, for example, it is the usual practice to require law enforcement officers to complete reports respecting accidents, investigations, and other activities. Law enforcement officers are frequently required to maintain a continuous log of their activities during their tour of duty. Often several types of report forms must be available to the officer as he embarks upon a particular tour of duty. In the past, the conventional clip boards have been available and some specialized clip boards have been designed for use by law enforcement officers. Particular requirements are imposed in this profession because of the necessity to have the report forms readily and quickly available with minimum additional weight and inconvenience.

In the transportation industry, it is frequently necessary for the operator of a tuck, a dispatcher, and other individuals to complete reports within the scope of their activities. Frequently it is necessary for various professionals and tradesmen to work from work orders, specifications, and other sources of information and instruction. Engineers, for example, often work from specification sheets and make notes, take data, or otherwise record information on plain or specially prepared papers.

In the course of duty of many professionals and tradesmen, they are required to have ready access to numerous pieces of loose paper, such as work orders, vouchers, bills of lading, etc. The necessity for carrying these assorted and loose papers along with report pads, etc., have been a vexatious, time consuming and largely wasteful activity on the part of highly skilled tradesmen and professional people. One of the features of this invention is to provide a container for loose papers, specialized reports, along with a writing surface in an extremely light, compact and convenient form. Many individual and collective advantages accrue from the invention and will be apparent from the drawings and from the description of the invention.

Generally, the invention comprises in combination two separate report storage compartments to which access may be had individually or together in combination with a clip board writing surface and retaining means.

IN THE DRAWINGS

FIG. 3 is a perspective view of the report containing clip board showing the writing surface and the first container raised giving access to the second report container.

FIG. 4 is a cross-section of a portion of the second container showing a pencil compartment taken substantially along lines 4—4 in the direction of the arrows as shown in FIG. 3.

FIG. 6 is a cross-sectional view of the hinge area of the box showing the writing surface and the first container raised taken substantially along lines 6—6 in the direction of the arrows as shown in FIG. 3.

In the following description, the invention is disclosed in terms of the best mode presently contemplated by the inventor for making and using the invention and with reference to the specific structures and structural relationship; however, the disclosure is not intended to be limiting in nature and many equivalent structures may be used within the scope of the invention as defined in the claims.

Figure 1:
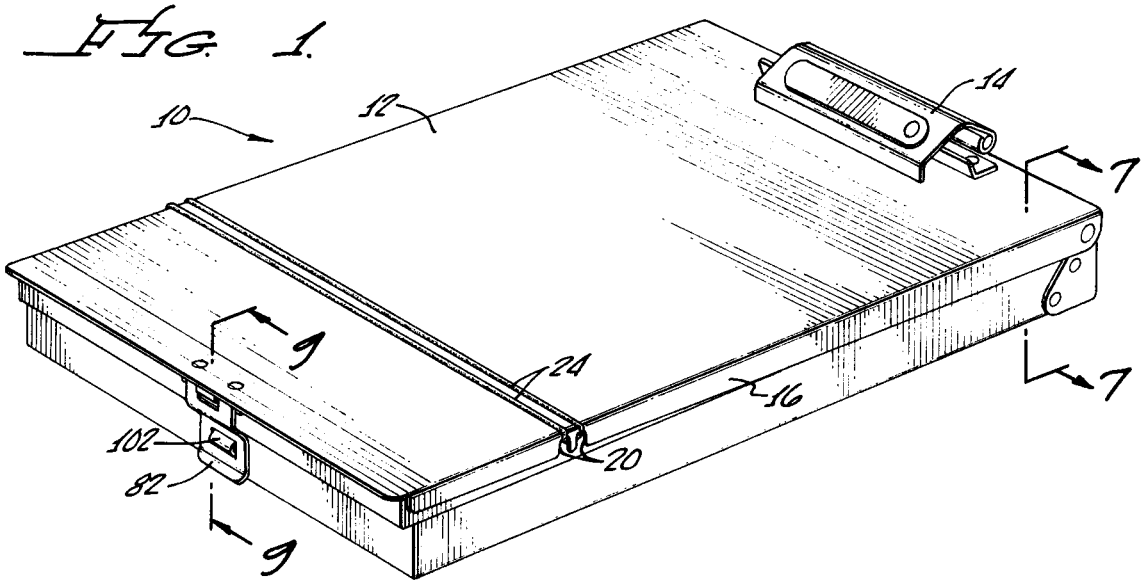
FIG. 1 is a perspective showing the report storage container and clip board of this invention in the fully-closed position.
Figure 7:
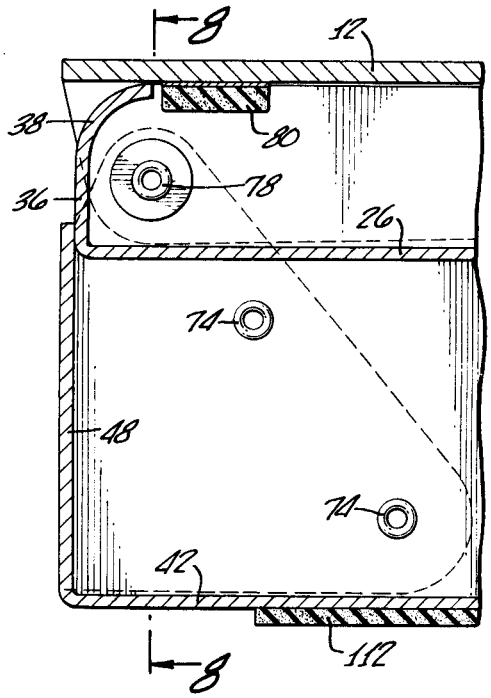
FIG. 7 is a cross-sectional view of the hinge area with both compartments closed and covered by the writing surface taken substantially along lines 7—7 in the direction of the arrows as shown in FIG. 1.

The report clip board and report container of the invention constitutes a unique and highly useful and convenient combination shown generally at 10 at FIG. 1 and comprises a writing surface 12 in combination with a paper or pad clip 14. The writing surface, and the rest of the container and related structures, may be made of any convenient material. For lightness, durability, and attractiveness, however, a hard anodized aluminum sheet approximately one-sixteenth-inch in thickness has been found to be the most suitable material for the writing surface and for the major structural elements in the entire combination. The writing surface and the related containing structures may, of course, be made in any convenient size. For large size pads, often referred to as legal-size pads, the writing surface is preferrably approximately 9 inches by 14 inches, or 9 inches by 15 inches if a 14-inch pad is to be used. The entire structure can be dimensioned to accommodate letter-size pads or smaller size pads and reports. It is customary in some trades to use printed forms and pads 5 inches and 8 inches, 4 inches by 8 inches, etc., in dimension and the invention can readily be constructed to accommodate this size of working material.

The pad clip may be of any convenient construction. There are many such clips commercially available and these are easily adapted to use in the present invention. One such clip which has been found to be of particular convenience is described in U.S. Pat. No. 2,996,774.

The edge of the writing surface is turned downward to form flanges 16 and 18 which taper from the rear of the writing surface, where it is hinged to the remainder of the construction, to the front. This provides strength and rigidity to the writing surface, seals the edge of the intermediate container, and provides the hinging structure for the writing surface.

In many trades and professions the invention is used outdoors. Indeed, the greatest utility and advantage of the invention is enjoyed in the outdoor environment.

The construction is such that pads and reports can be placed inside either of the containing portions of the construction and protected from rain and other elements. In addition, a unique feature of the invention is the provision of means to hold down the report being prepared to prevent its being blown about without diminishing the convenience of using the entire combination. The hold-down means includes a double notch 20 on one side and a double notch 22 on the other side of the writing surface to accommodate a rubber band, one of which is shown at 24, in each of the notches. The rubber band, or other elastic retainer, can be placed over all of the paper clipped on the writing surface or only a portion of it. Two retaining bands may be utilized for different portions of papers being held on the writing surface. Thus, the user has available means to restrain the papers from blowing and to hold them in place during preparation of the report and retains access to the container portions of the invention as well.

A first container tray intermediate the writing surface and the lower container tray is especially designed to hold a form pad, a writing pad, a log, or other document to which ready and convenient access is desirable. This container includes a bottom 26 which has an aperture of lift opening 28 through which the user may extend his finger or thumb to raise the pad from the surface 26. This is a very convenient feature and obviates the necessity of digging along the edges of the pad to gain access to sufficient numbers of sheets to lift the pad.

The tray is defined on two sides by raised lips 30 and 32, by front lip 34 and by a rear lip 36 which includes an in-turned ledge 38, the purpose and operation of which will be discussed hereinafter. The rear of the tray is commonly hinged with a writing surface by hinge mechanism which will be described in detail. The front lip of the tray includes a notch 40 which has a wide upper portion with a centered narrower lower portion to accommodate the latch mechanism which will be described hereinafter.

As best shown in FIG. 3, the second storage area or bottom tray is designed for storing finished reports, loose papers or pads and for containing pencils and the like. The report storage tray includes a bottom 42 with raised vertical sides 44 and 46, rear end 48 and a front end 50. The rear of the report storage tray is hinged to the form pad tray and to the writing surface so that the entire combination forms a hingeably connected dual storage and writing surface clip board.

Near the front end of the report storage tray is a divider partition 52 which includes an upright portion 54 and a sloping portion 56. In the embodiment illustrated, the partition is secured to the bottom of the tray 42 by means of a base lip 58 at one side and another base lip 60 on the other side and a plurality of rivets 62 and 64. Of course different shaped partitions may be used and any method of connection may be used. In the illustrated embodiment, metal rivets are shown and have been found to be most satisfactory. Connections may be made by welding, adhesives, or any other fastener means, however.

The rear or sloping portion 56 of the partition includes an access aperture 66 to permit the user to reach under the papers stored in the report storage tray to pick them out of the tray.

Another important feature is the inclusion of a buffer pad 68 at one end, at least, of the pencil compartment defined by the front 50 and the partition 52 of the tray.

Preferably, a buffer pad is placed at both ends of the pencil compartment. This is particularly important in trades professions where the Posse Box container and the clip board combination is carried about and subjected to rough handling. In police work, for example, the pencils in the compartment are rattled about and slipped from side to side very rapidly as the police vehicle rounds curves, etc. The buffer pad prevents damage to points of ballpoint pens, breakage of pencil leads, and in general reduces damage to the instruments contained in the pencil compartment.

Figure 2:
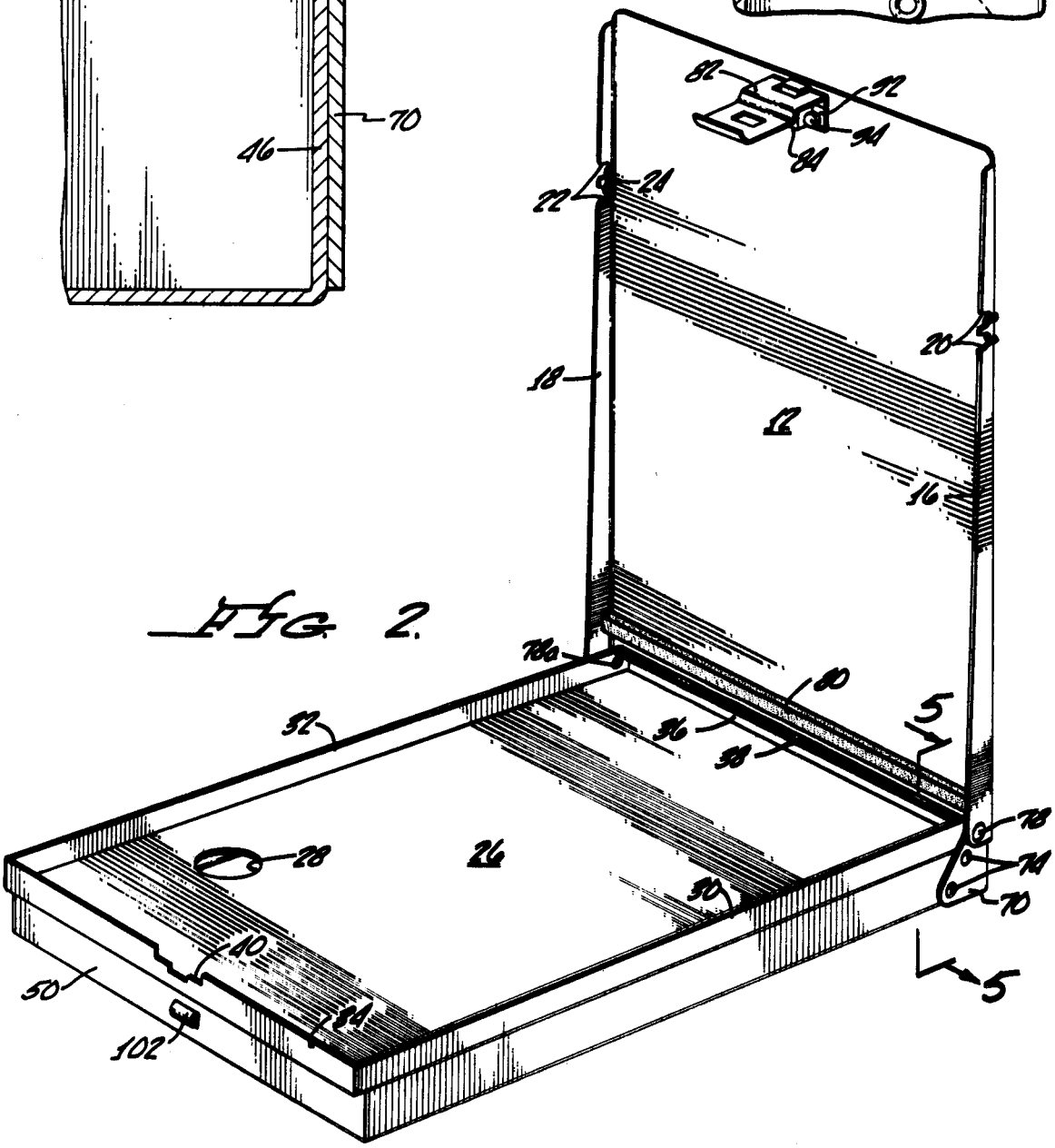
FIG. 2 is a perspective showing the report container and writing box with the writing surface raised exposing a first report container.

The hinge structure permits the container and clip board of the invention to conform to three fundamental configurations illustrated in FIGS. 1, 2 and 3 and the details of the hinge structure are illustrated in FIGS. 5, 6, 7 and 8. The rear of the lower container is, in the preferred embodiment, formed of a unitary extension of the bottom 42 which includes the raised edge portion 48 with extending tabs 70 and 72 which, during assembly, are folded around to lie adjacent the edges 44 and 46 and aré secured thereto by rivets 74 and 76, or by any other fastening means. Of course, the tabs 70 and 72 can be constructed separately and secured to the container in any desirable manner.

Hinge pins 78 and 78*a* extended through the tabe 70 and 72, through a round aperture of substantially the same diameter as the rivets in the upright lips 30 and 32 of the intermediate container and through an aperture in the down-turned flanges 16 and 18 of the writing surface. The aperture through the down-turned flanges 16 and 18 is not round, however. This aperture is substantially in the configuration of 2 apertures of the diameter of the rivet drilled approximately one-half rivet diameter apart and widened along the longitudinal axis of the aperture resulting to provide a longitudinal width equal to the diameter of the rivet. The longitudinal axis of these apertures is approximately perpendicular to the plane of the writing surface. Consequently, when the writing surface is raised, the axis of pivoting migrates to permit the writing surface to move across the vertical position, with respect to the plane of the container, to a position of about 2° to 15° beyond the vertical such that it will stay up when lifted. This is illustrated best in FIGS. 2 and 5.

Figure 5:
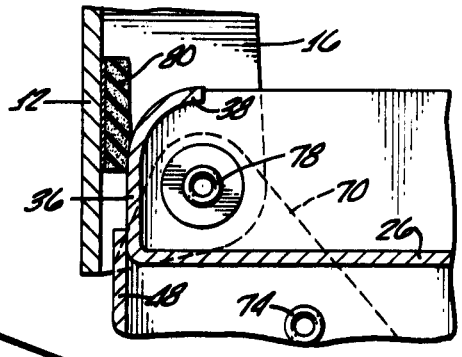
FIG. 5 is a cross-section showing the hinge area of the box with the writing surface raised above the first container taken substantially along lines 5—5 in the direction of the arrows as shown in FIG. 2.

Also as best illustrated in FIGS. 2 and 5, resilient pad 80 extends across the width of the underside of the writing surface 12 and bears against the rear wall 36 and the in-turned edge 38 of the intermediate report pad tray. This prevents small slips of paper and the like from falling out through the hinge area.

Figure 9:
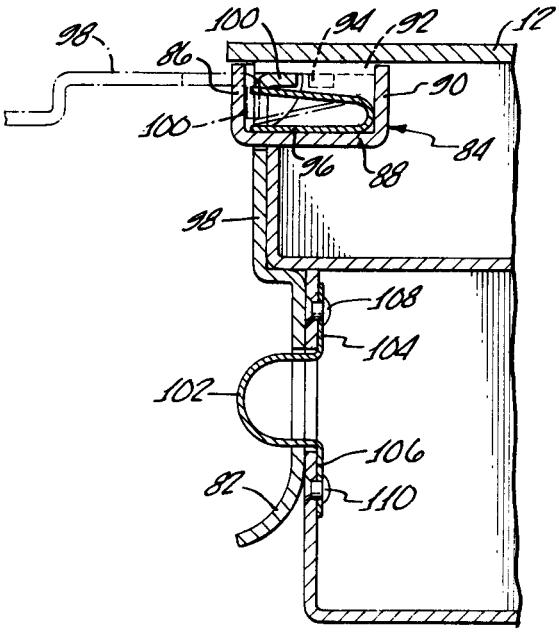
FIG. 9 is a cross-sectional view of the latch mechanism taken substantially along line 9—9 in the direction of the arrows as shown in FIG. 1.
Figure 8:
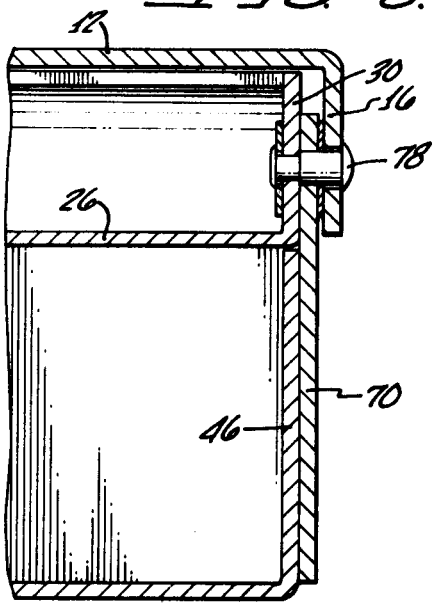
FIG. 8 is another cross-sectional view of the hinge area on one side taken substantially along lines 8—8 in the direction of the arrows as shown in FIG. 7.

The latch mechanism is shown generally in FIGS. 1, 2 and 3 and is shown in greater detail at FIG. 9. The latch 82 is secured by a latch keeper bracket shown generally at 84. The keeper bracket includes a front wall 86, a lower wall 88 and a rear wall 90, and is secured to the bottom of the writing surface by means of a pair of end lips 92 which are bent out to provide a flat portion which lies against the underside of the writing surface and is secured thereto by a pair of rivets 94. Again, the method of securing the keeper to the writing surface is a matter of choice and securement may be by welding, adhesive fixtures, etc. The vertical portion of the end lips 92, viewing the structure as shown in FIG. 9, includes an arcuate opening which accommodates the end portion of the latch 82 inside the housing. The latch 82 includes a shank 98 and a rearwardly extending compression lip 100 which, when the latch is closed, lies adjacent and generally parallel to the bottom of the writing surface 12. When the latch is opened, the compression lip pivots downwardly compressing the U-shaped leaf spring 96. As the latch moves to its full open position, it moves over-center on the leaf spring and, therefore, is retained in the open position by the compression of the leaf spring 96. The closed position is shown in full line in FIG. 9 with the open position being shown in that FIG. by dashed lines. The latch 82 also includes an aperture which receives a keeper loop 102 extending through an aperture in front of the lower container and is secured thereto by a flat portion 104 above and a like portion 106 below and rivets 108 and 110, or by any other convenient means of securement.

As shown in FIG. 9, the shank 98 of the latch member 82 extends downwardly, it curved inwardly toward the rear, and then extends downwardly over the front surface of the lower container. A ledge is formed by the curved portion of the shank which extends around and under the intermediate tray to secure the intermediate tray to the bottom of the writing surface. Thus, the writing surface and the intermediate tray may be opened as a unit or, optionally, the writing surface may be opened away from the intermediates tray according to the desires of the user.

Another feature of the invention is the inclusion of a non-slip material, shown at 112, on the bottom of the combination double container and clip board. The non-slip material may be a non-skid paint, but, preferably, is a cork-filled rubber composition having a relatively rough surface. These compositions are well known. This feature is particularly important in police work where it is desirable to place the box on the seat and have it stay there during maneuvering of the vehicle or to place it on the hood or fender of a vehicle without slippage or marring the surface of the vehicle. This non-slip feature finds advantage in other trades and professions as well.

The corners of the containers may be secured together with riveted brackets, welds, adhesive brackets or by any other convenient means.

It will be apparent that there will be many variations which can be made from the precise structural details described in the interest of a complete disclosure without departing from the fundamental concept of the invention and without departing from the scope of the claims which follow.

What is claimed is:

1. A three-part combination report clip board and storage container comprising:

an open top bottom container formed as a flat tray with upstanding sides, said container of a width, breadth and depth to receive report forms and pads in one open top compartment thereof and pencils or other writing instruments in a smaller open top compartment therein, the two open top compartments being divided by a partition which includes and access aperture for permitting the user to reach under the papers contained in the larger compartment and at least one buffer pad in the pencil compartment;

an intermediate, open top report pad container formed as a flat tray with upstanding sides, said container of a width, length and depth to accommodate a writing pad, said tray forming a writing surface having an upper flat surface of a width and length to accommodate a writing pad, said intermediate container overlying said bottom container to form a lid therefor, said intermediate container extending beyond said bottom container on at least one side to facilitate opening said lid;

means forming a writing surface for clipping a pad to the surface, down-turned flanges on the sides of the writing surface, said flanges forming at least one notch to retain in position an elastic paper retaining means across the writing surface but not around either of the containers, said writing surface means overlying said intermediate container to form a lid therefor, said writing surface means extending beyond said intermediate container on at least one side to facilitate opening said lid;

the lower container, intermediate container and writing surface being hinged together by a single axis hinge which includes a pair of hinge pins, the hinge being so constructed and configured as to pivotly position the intermediate tray above the lower tray and to pivotly position the writing surface above the intermediate tray, to permit the writing surface, when opening, to cross an over-center position to a position beyond the vertical plane, with respect to the plane of the bottom tray;

the intermediate tray having a rear lip with an inturned ledge, a buffer pad sealer of resilient material affixed to the bottom side of the writing surface member to co-act with the rear lip structure to prevent small slips of paper from falling out through the hinge area;

latch means secured to the underside of the writing surface member extending over the intermediate tray selectively to secure the intermediate tray to the bottom of the writing surface or to release the intermediate tray to rest on the top of the bottom tray and means secured to the front end of the bottom tray to keep the latch in the closed position;

the flat tray of the intermediate container including an opening to permit the user to lift a pad from the tray by extending a finger or thumb through the opening; and non-skid means on the outside of the bottom container.

2. A three-part combination report clip board and storage container comprising, in combination:

a clip board portion which includes a writing surface and means for attaching paper to the writing surface;

a first intermediate open top storage portion in the form of a bin for holding a pad of paper, said first storage portion underlying said clip board and covered thereby; said first storage portion extending beyond said second storage portion on at least one side a second open top storage portion in the form of a bin for holding papers, said second storage portion underlying said first storage portion and covered thereby;

single axis hinge means connecting the clip board portion and the first and second storage portions together at the rear of each in relative pivotal relationship, whereby the first storage portion overlays the second storage portion and the clip board portion overlays the first storage portion when the container is closed;

said hinge means being so configured and constructed as to permit the clip board portion to pass through a perpendicular position relative to the first storage portion and the second storage portion to a position beyond the vertical whereby the clip board portion will, when open, normally remain open; and latch means for securing the container in the closed configuration.

3. The invention defined in claim 2 wherein:

the hinge means includes a pair of pins extending through apertures in down-turned side flange portions of the clip board portion, said apertures having longitudinal axes approximately perpendicular to the writing surface of greater length than the diameter of the pins.

4. The invention defined in claim 2 wherein:

the latch means includes means for engaging the first storage portion separately from the second storage portion for holding the first storage portion to the underside of the clip board portion to permit opening of only the second storage portion.

5. The invention defined in claim 2 wherein:

the second storage portion includes a partition dividing the storage space into a pencil compartment and a paper compartment and including buffer means in at least one end of the pencil compartment for preventing damage to writing instruments.

6. The invention defined in claim 2 wherein:

the first storage portion includes upstanding side walls and upstanding front and rear walls, and including a resilient sealing means secured to the bottom of the clip board portion in close proximity to the hinge means and the rear wall of the first storage portion for coacting with the storage portion to prevent loss of papers through the hinge means.

7. The invention defined in claim 2 wherein:

the clip board portion includes means for locating and holding in position elastic bands for holding papers on the writing surface in position on the writing surface in an area spaced from the means for attaching paper to the writing surface, said locating means being so constructed and located as to permit location of said bands without interference with the opening and closing of the first and second storage portions.

8. The invention defined in claim 2 wherein:

the first storage portion includes a bottom which defines an aperture so positioned and formed as to permit the user to insert a finger to raise the contents of the storage portion away from the bottom to permit easy access to said contents.

9. The invention defined in claim 2 further including:

non-skid means on the bottom of the container.

* * * * *